US008818611B2

(12) United States Patent
Shin et al.

(10) Patent No.: US 8,818,611 B2
(45) Date of Patent: Aug. 26, 2014

(54) METHOD AND APPARATUS TO EVALUATE A STARTING SYSTEM FOR AN INTERNAL COMBUSTION ENGINE

(75) Inventors: Kwang-Keun Shin, Rochester Hills, MI (US); Mutasim A. Salman, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 255 days.

(21) Appl. No.: 13/209,595

(22) Filed: Aug. 15, 2011

(65) Prior Publication Data

US 2013/0046435 A1 Feb. 21, 2013

(51) Int. Cl.
*G07C 5/00* (2006.01)

(52) U.S. Cl.
USPC ..... 701/29.1; 701/29.2; 701/30.5; 701/31.1; 701/34.4; 123/339.14; 123/436

(58) Field of Classification Search
USPC ..... 701/29.1–34.4
See application file for complete search history.

(56) References Cited

U.S. PATENT DOCUMENTS 5,687,692 A * 11/1997 Togai et al. ..... 123/436
5,821,756 A * 10/1998 McShane et al. ..... 324/430
6,612,386 B2 * 9/2003 Tamai et al. ..... 180/65.25
7,134,414 B2 * 11/2006 Ries-Mueller et al. .... 123/179.3
8,380,388 B2 * 2/2013 Shin et al. ..... 701/29.2
2001/0013768 A1 * 8/2001 Suzuki et al. ..... 320/134
2002/0179347 A1 * 12/2002 Tamai et al. ..... 180/65.2
2002/0179348 A1 * 12/2002 Tamai et al. ..... 180/65.2
2004/0174018 A1 * 9/2004 Itoh ..... 290/40 C
2004/0221828 A1 * 11/2004 Ries-Mueller et al. .... 123/179.3
2007/0227237 A1 10/2007 Brott et al.
2008/0072859 A1 * 3/2008 Esaka et al. ..... 123/179.3
2008/0278120 A1 * 11/2008 Sato ..... 322/28
2010/0038158 A1 * 2/2010 Whitney et al. ..... 180/65.265
2010/0242905 A1 * 9/2010 Machida et al. ..... 123/339.14
2010/0305793 A1 * 12/2010 Kidston et al. ..... 701/22
2011/0012553 A1 * 1/2011 Sloan et al. ..... 320/105
2011/0180031 A1 * 7/2011 Hamane ..... 123/179.4
2012/0159971 A1 * 6/2012 Fink et al. ..... 62/56
2013/0001006 A1 * 1/2013 Gibson et al. ..... 180/446
2013/0002210 A1 * 1/2013 Gibson et al. ..... 322/7

FOREIGN PATENT DOCUMENTS

WO 2008156478 A1 12/2008

* cited by examiner

*Primary Examiner* — Khoi Tran
*Assistant Examiner* — Jonathan L Sample

(57) ABSTRACT

A starting system for an internal combustion engine includes a starter motor and a battery. A method for evaluating the starting system includes detecting a fault associated with the starter motor when a minimum starting system voltage during a cranking event is greater than a threshold minimum starting system voltage determined in relation to an engine acceleration parameter, and detecting a fault associated with the battery when the engine acceleration parameter is less than a minimum threshold for the engine acceleration parameter.

17 Claims, 3 Drawing Sheets

METHOD AND APPARATUS TO EVALUATE A STARTING SYSTEM FOR AN INTERNAL COMBUSTION ENGINE

TECHNICAL FIELD

This disclosure is related to starting systems for internal combustion engines.

BACKGROUND

The statements in this section merely provide background information related to the present disclosure. Accordingly, such statements are not intended to constitute an admission of prior art.

Vehicle electrical systems include electric machines, e.g., motors and accessory drive devices that receive electric power from energy storage devices, e.g., batteries, and are controlled by signals originating from control modules and other control devices and logic circuits. One electric circuit is a starting system that includes an electric-powered starter motor that spins an internal combustion engine when activated with an ignition switch. Control modules are electrically powered and functional to operate as intended only when electric power is greater than a minimum operating voltage for integrated circuits and other components thereof, e.g., 5V DC.

Starting system faults may cause an engine crank fault that results in an engine non-start event. Known starting system faults include faults associated with a starter motor, and a battery fault that may include a low state-of-charge or a low state of health resulting in a battery fault. A battery fault may be indicated by an increase in internal resistance of the battery.

During an engine starting event, power draw by a starter motor may cause battery voltage and system voltage to fall below a minimum voltage for engine starting. The minimum voltage for engine starting is greater than a minimum operating voltage for the integrated circuits of the control modules

SUMMARY

A starting system for an internal combustion engine includes a starter motor and a battery. A method for evaluating the starting system includes detecting a fault associated with the starter motor when a minimum starting system voltage during a cranking event is greater than a threshold minimum starting system voltage determined in relation to an engine acceleration parameter, and detecting a fault associated with the battery when the engine acceleration parameter is less than a minimum threshold for the engine acceleration parameter.

BRIEF DESCRIPTION OF THE DRAWINGS

One or more embodiments will now be described, by way of example, with reference to the accompanying drawings, in which.

DETAILED DESCRIPTION

Figure 1:
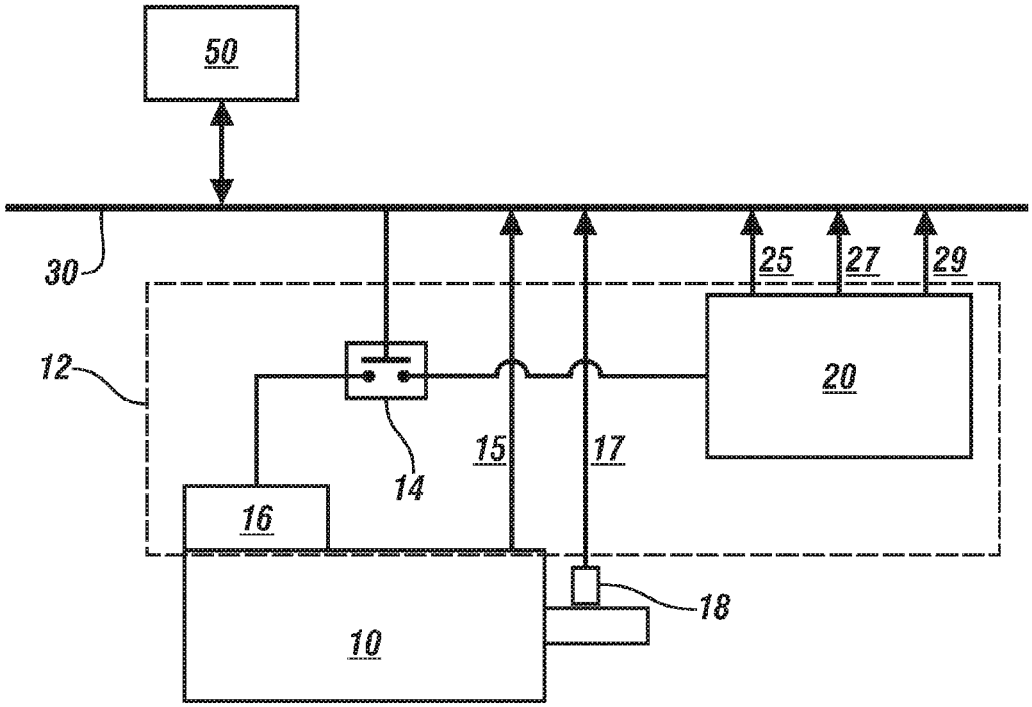
FIG. 1 illustrates an exemplary internal combustion engine including a starting system and a control system in accordance with the disclosure.

Referring now to the drawings, wherein the showings are for the purpose of illustrating certain exemplary embodiments only and not for the purpose of limiting the same, FIG. 1 schematically shows an internal combustion engine 10 including a starting system 12 and a control system 50. The starting system 12 preferably includes an engine starter motor 16, an ignition switch 14 and a battery 20. In one embodiment the internal combustion engine 10 is an element of a powertrain system that is employed on a vehicle.

The engine 10 converts fuel stored in a fuel tank to mechanical power through a combustion process. The engine 10 is any internal combustion engine, and may be a multi-cylinder direct fuel injection internal combustion engine.

The engine 10 is equipped with a plurality of actuators and sensing devices for monitoring operation and delivering fuel to form a combustion charge to produce torque that is responsive to an operator torque request. In one embodiment, the engine 10 is a spark-ignition engine configured to operate as a spark-ignition combustion mode with combustion controlled by a spark ignition system, and may include operation in a homogeneous charge spark-ignition combustion mode. Alternatively, the engine 10 may be a compression-ignition engine configured to operate in a compression-ignition combustion mode with combustion controlled by timing of injected fuel. Engine actuators preferably include fuel injectors, air flow controllers, spark-ignition systems on engines so equipped, and other devices associated with controlling engine operation to control the aforementioned engine states. Engine sensing devices preferably include a coolant temperature sensor or other device for monitoring engine temperature 15 and a crankshaft position sensor 18 configured to monitor rotational speed 17 of the engine 10.

The battery 20 may be any electrical energy storage device, and in one embodiment is a multi-celled low-voltage lead-acid battery. Monitored parameters of the battery 20 include battery temperature 25, battery voltage 27, and battery current 29, from which a battery state-of-charge (SOC) parameter and a state-of-health (SOH) parameter may be determined, as is known to skilled practitioners. The control system 50 is configured to determine the SOC parameter using information including the battery voltage 27 and battery current 29. The control system 50 is configured to determine the SOH parameter using information including an internal resistance of the battery 20 that may be determined using calculations and calibrations, as described herein with reference to FIG. 4.

It is appreciated that information transfer to and from the control system 50 may be accomplished using one or more communications paths, e.g., communications bus 30, which may include one or more of a direct connection, a local area network bus, and a serial peripheral interface bus.

The starter motor 16 may include any engine cranking device, and is a permanent-magnet DC electric motor with an attached starter solenoid in one embodiment. In such an embodiment, a rotatable shaft of the starter motor 16 includes a moveable drive pinion gear that is configured to meshingly engage a starter ring gear attached to a crankshaft of the engine 10 when the starter solenoid is activated during a cranking event. When the ignition switch 14 is activated, electric current is supplied to the starter solenoid to cause the moveable drive pinion gear to meshingly engage the starter ring gear attached to the crankshaft of the engine 10 and supply electric current to spin the starter motor 16, thus spinning the engine 10.

The ignition switch 14 is configured to initiate a cranking event by electrically connecting the engine starter motor 16 to the battery 20 in response to an operator key-on command or in response to an autostart command. It is appreciated that the engine speed is 0 RPM, i.e., the engine is in a stopped state and is not rotating prior to initiating the cranking event. A key-on engine starting event is executed in response to an operator key-on command to the ignition switch 14, for example when an operator first enters a vehicle to begin a trip. It is appreciated that a key-on engine starting event includes a remote-start event and other similar operations. An autostart engine starting event is executed in response to a command from the control system 50 to activate the ignition switch 14, for example subsequent to an autostop command during ongoing vehicle operation.

The control system 50 is configured to control operation of the engine 10 during each engine starting event including an associated cranking event. An engine starting event includes coincidentally executed engine fueling and spark (on spark-ignition engines). Each cranking event preferably includes a command to start the engine 10 wherein the ignition switch 14 is activated to electrically connect the starter motor 16 to the battery 20, causing the starter motor 16 to spin. The control system 50 coincidentally controls engine fueling and spark (on spark-ignition engines) to start the engine 10 by executing other engine control functions related to fueling and firing the engine 10.

Figure 2:
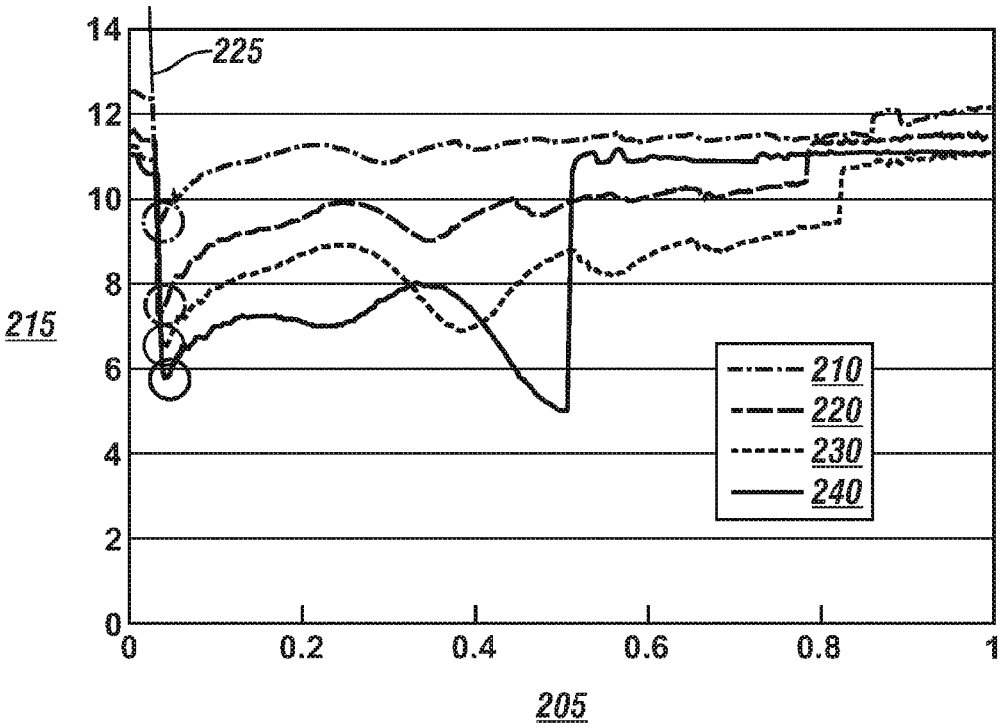
FIG. 2 illustrates battery voltage data associated with cranking an exemplary internal combustion engine in accordance with the disclosure.

FIG. 2 graphically shows data associated with cranking events for an embodiment of an internal combustion engine, e.g., the engine 10 with starting system 12 described with reference to FIG. 1. Battery voltage (V) 215 is shown on the y-axis, and elapsed time (sec.) 205 is shown on the x-axis. Depicted results include the battery voltage during engine cranking events including a strong cranking event 210, a medium cranking event 220, a weak cranking event 230, and a cranking fault 240, each initiated at a crank activation point 225. The strong cranking event 210, medium cranking event 220, and weak cranking event 230 are relative terms that are defined with reference to engine acceleration, which is defined with reference to an engine acceleration parameter described herein. Cranking fault 240 is a cranking event that results in a non-start event.

When operation of the starter motor 14 is within manufacturer specifications, a measurement of minimum battery voltage during the cranking event may be used to indicate a state of function (SOF) of the battery 20. A relatively low minimum battery voltage during the cranking event indicates a relatively low available battery power. A relatively high minimum battery voltage during the cranking event indicates a relatively high available battery power. Battery power may be indicated by the SOC parameter and/or the SOH parameter. It is appreciated that the battery voltage is readily monitored, e.g., as the battery voltage 27 of the battery 20 for the system depicted with reference to FIG. 1.

A relationship between the minimum battery voltage during a cranking event and the output voltage may be expressed as follows:

$$V_{min} = \frac{R_m}{R_m + R_b} V_o \quad [1]$$

wherein $V_{min}$ is the minimum starting system voltage during a cranking event and reflects the minimum battery voltage, $V_o$ is a static voltage of the battery 20, and indicates battery voltage prior to a cranking event, $R_m$ is an electrical resistance of the starter motor 16, and $R_b$ is an internal electrical resistance of the battery 20.

Table 1 numerically shows an analysis using EQ. 1 with a starting system, a battery fault indicated by an increased state for $R_b$, i.e., the internal resistance of the battery, and a starter motor fault indicated by an increased state for $R_m$, i.e., the resistance of the starter motor.

TABLE 1

| Parameter | $V_o$ | $R_b$ | $R_m$ | $V_{min}$ |
|---|---|---|---|---|
| Functional System | 12 V | 5 mΩ | 10 mΩ | 8 V |
| Battery Fault | 12 V | 10 mΩ | 10 mΩ | 6 V |
| Battery and Starter motor Fault | 12 V | 10 mΩ | 20 mΩ | 8 V |

The results in Table 1 indicate that the minimum starting system voltage $V_{min}$ during a cranking event is the same for a functional system as for a system having both a battery fault and a starter motor fault. Thus, a combination of a battery fault with a starter motor fault may be masked by a system that monitors minimum voltage during a cranking event.

Figure 3:
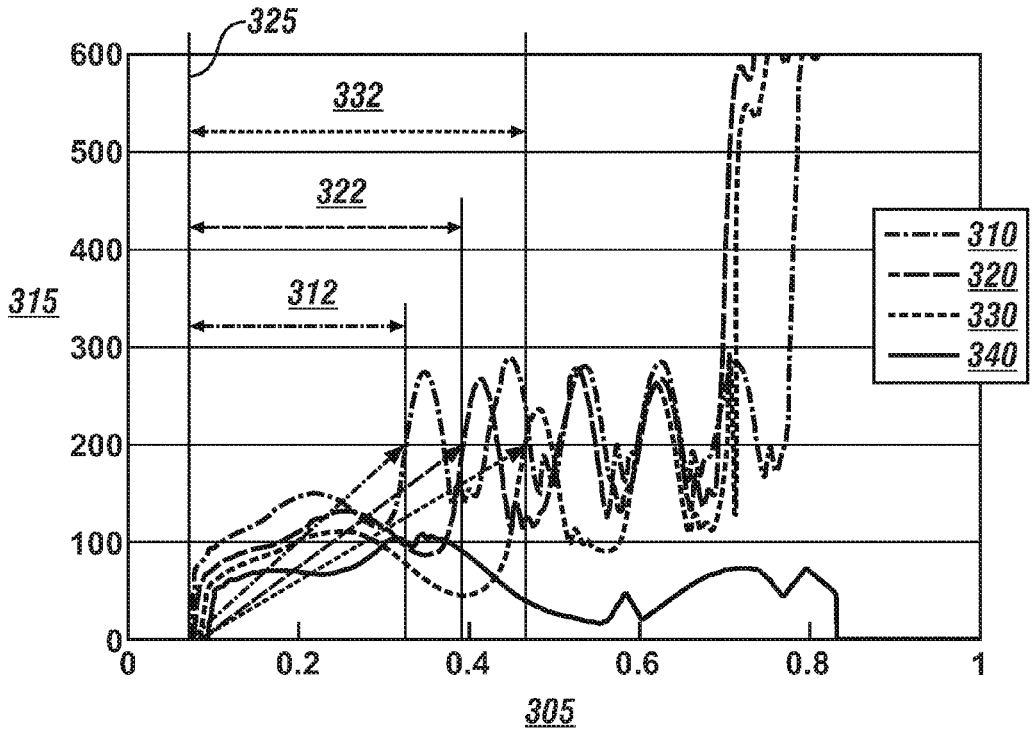
FIG. 3 illustrates engine speed data associated with cranking an exemplary internal combustion engine in accordance with the disclosure.

FIG. 3 graphically shows data associated with cranking an internal combustion engine, e.g., the engine 10 described with reference to FIG. 1. Engine speed (RPM) 315 is shown on the y-axis, and elapsed time (sec.) 305 is shown on the x-axis. Results include the engine speed during engine cranking associated with a strong cranking event 310, a medium cranking event 320, a weak cranking event 330, and a crank fault 340, each originating from a crank activation point 325, and defined with reference to an engine acceleration parameter.

An engine speed threshold 335 is depicted, and is preset at 200 RPM in one embodiment. Results include elapsed times for the engine speed to achieve the engine speed threshold 335 during engine cranking associated with the strong cranking event 310 (312), the medium cranking event 320 (322), and the weak cranking event 330 (332). As is appreciated, the engine speed does not achieve the engine speed threshold 335 when there is a crank fault 340. The elapsed time for the strong cranking event 310 (312) is less than the elapsed time for the medium cranking event 320 (322), which is less than the weak cranking event 330 (332).

The engine acceleration parameter corresponding to engine cranking is determined. The engine acceleration parameter may be used as an index of cranking SOF, which preferably includes the battery SOF and a starter motor SOF. SOF terms indicate an ability of a component or a system to perform its assigned function, e.g., to crank an engine.

One exemplary engine acceleration parameter is an average engine acceleration parameter $A_{200}$ that is calculated by dividing the engine speed threshold 335 (e.g., 200 RPM) by the elapsed time for the engine to achieve the engine speed threshold 335 ($t_{200}$) from a non-rotating condition or 0 RPM, as follows.

$$A_{200}=200/t_{200} \quad [2]$$

The average engine acceleration parameter $A_{200}$ has units of RPM/sec. It is appreciated that other engine acceleration parameters may be calculated, depending upon specific characteristics of engine cranking for differently configured engines and starting systems.

Figure 4:
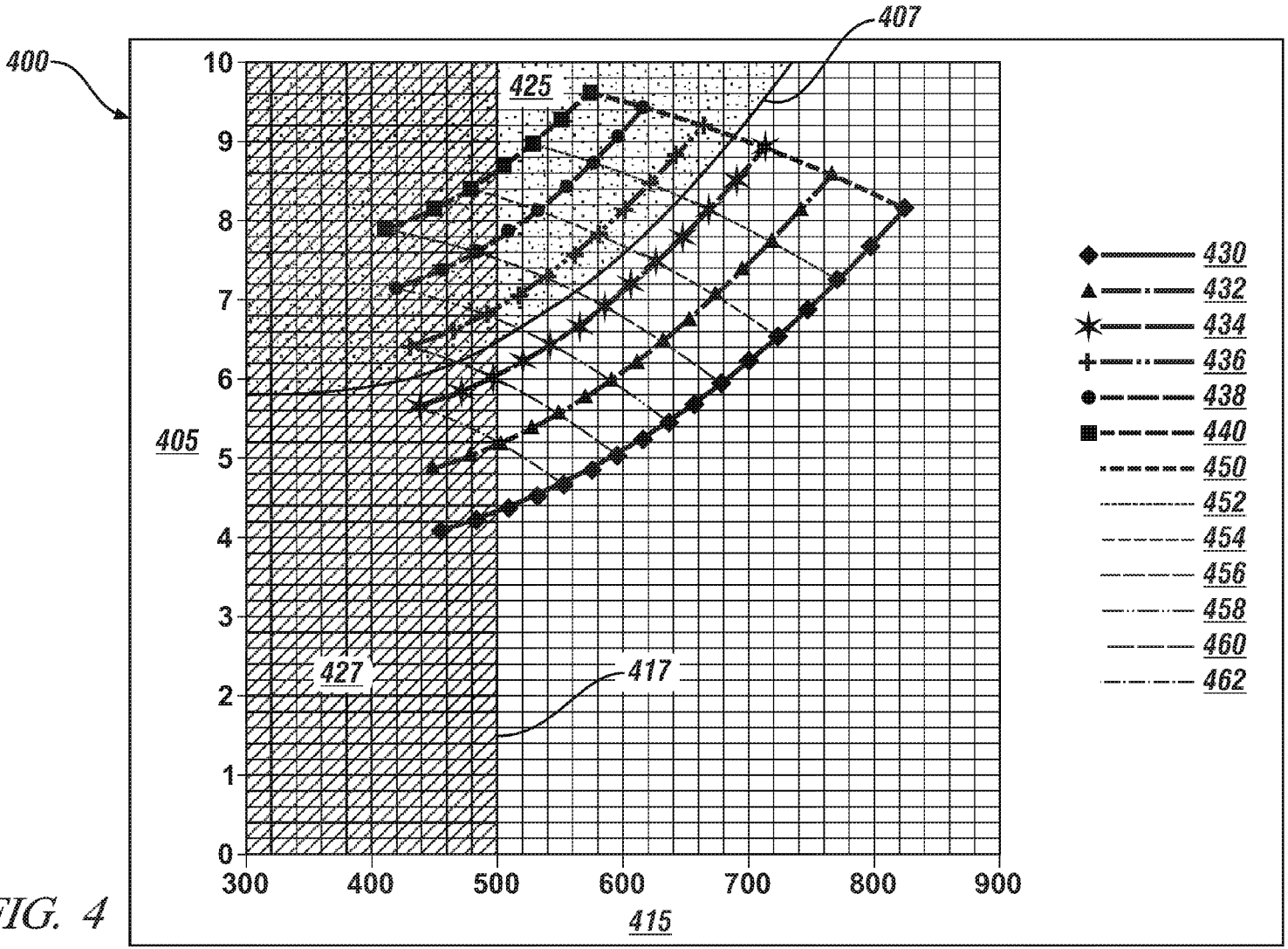
FIG. 4 illustrates minimum battery voltage in relation to an engine acceleration parameter for specific values of internal battery resistance and starter motor resistance for an exemplary internal combustion engine in accordance with the disclosure.

FIG. 4 is a graph 400 that shows minimum battery voltage ($V_{min}$) 405 on the y-axis and average engine acceleration parameter $A_{200}$ (RPM/sec) 415 on the x-axis. Plotted data includes results determined for known values of internal battery resistance $R_b$ and starter motor resistance $R_m$ for an embodiment of the starting system 12 and the engine 10 at single known states for ambient temperature, battery temperature, engine temperature, and other parameters. It is appreciated that there may be a plurality of analogous graphs for one embodiment of the starting system 12 and the engine 10 that represent operation at other ambient temperatures, battery temperatures, engine temperatures, and other parameters.

An algorithmic spreadsheet configured to execute EQ. 1 is employed to calculate magnitudes of the minimum starting system voltage $V_{min}$ for a plurality of starter motor resistances $R_m$ including 100%, 120%, 140%, 160%, 180% and 200% of a resistance of a functional new starter motor measured at an ambient temperature, e.g., 20° C. and a plurality of internal battery resistances $R_b$ including 100%, 140%, 180%, 220%, 260%, 300%, and 340% of a functional new battery measured at an ambient temperature, e.g., 20° C. at the output voltage of the battery $V_o$. The output voltage of the battery $V_o$ is an expected static output voltage thereof, and may be associated with a 12 V battery, a 42 V battery or other battery.

A simulation model of the starting system 12 includes calibrated algorithms that mathematically describe the embodiment of the starting system 12 and the engine 10. The simulation model of the starting system 12 is employed to estimate an elapsed time for the engine speed to achieve the engine speed threshold ($t_{200}$) for the plurality of starter motor resistances $R_m$ including 100%, 120%, 140%, 160%, 180% and 200% and the plurality of internal battery resistances $R_b$ including 100%, 140%, 180%, 220%, 260%, 300%, and 340%, preferably at the output voltage of the battery $V_o$. Simulation models for starting systems are known and not described herein. The elapsed time for the engine speed to achieve the engine speed threshold $t_{200}$ is used to calculate the average engine acceleration parameter $A_{200}$.

Lines 430, 432, 434, 436, 438, and 440 are isometric lines for the starter motor resistances $R_m$ of 100%, 120%, 140%, 160%, 180% and 200%, respectively, indicating corresponding minimum battery voltages $V_{min}$ and average engine acceleration parameters $A_{200}$ over the range of the internal battery resistances $R_b$.

Lines 450, 452, 454, 456, 458, 460 and 462, are isometric lines for the internal battery resistances $R_b$ of 100%, 140%, 180%, 220%, 260%, 300%, and 340%, respectively, indicating corresponding minimum battery voltages $V_{min}$ and average engine acceleration parameters $A_{200}$ over the range of the starter motor resistances $R_m$.

The starter motor and battery may be characterized by measured parameters during a starting event that include the minimum battery voltage $V_{min}$ and the average engine acceleration parameter $A_{200}$. A first region 427 is associated with a battery fault and is delineated by an area on the graph 400 that is less than a minimum threshold for average engine acceleration parameter $A_{200}$_th, indicated by threshold line 417, across the range of minimum battery voltages $V_{min}$ and less than a minimum threshold battery voltage during a cranking event in relation to the average engine acceleration parameter $A_{200}$ ($V_{min}$ _th($A_{200}$)) represented by threshold line 407. The minimum threshold for the average engine acceleration parameter $A_{200}$_th indicated by threshold line 417 is a single value of 500 RPM/sec in one embodiment, and indicates a capacity of the battery to provide electric power for cranking the engine. The minimum threshold for the average engine acceleration parameter $A_{200}$_th indicated by threshold line 417 may be calibrated by a skilled practitioner to reflect a threshold value for a specific embodiment of the starting system 12 and the engine 10.

A second region 425 is associated with a starter motor fault and is delineated by an area on the graph 400 that is greater than a minimum threshold battery voltage during a cranking event in relation to the average engine acceleration parameter $A_{200}$ ($V_{min}$_th($A_{200}$)) represented by threshold line 407. The threshold line 407 corresponds to a single value of the starter motor resistance $R_m$ of 150% in one embodiment, and indicates a capacity of the starter motor 16 to crank the engine 10. The minimum threshold battery voltage during a cranking event in relation to the average engine acceleration parameter $A_{200}$ ($V_{min}$_th($A_{200}$)) may be calibrated by a skilled practitioner to reflect a threshold value for a specific embodiment of the starting system 12 and the engine 10.

Figure 5:
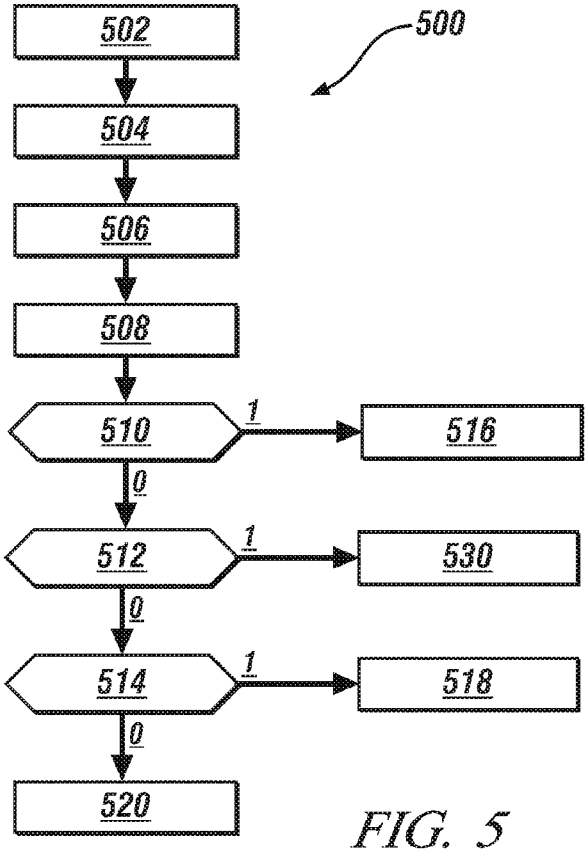
FIG. 5 illustrates a control scheme flowchart for evaluating a starting system for an exemplary internal combustion engine in accordance with the disclosure.

FIG. 5 illustrates a control scheme 500 flowchart for evaluating a starting system for an internal combustion engine including a starter motor and a battery, e.g., an embodiment of the starting system 12 and the engine 10 described with reference to FIG. 1. The control scheme 500 uses an embodiment of the graph 400 shown with reference to FIG. 4 that has been derived for the embodiment of the starting system 12 and the engine 10 described with reference to FIG. 1. The control scheme 500 is preferably executed in the control module 50 as one or more routines and associated calibrations.

Control module, module, control, controller, control unit, processor and similar terms mean any one or various combinations of one or more of Application Specific Integrated Circuit(s) (ASIC), electronic circuit(s), central processing unit(s) (preferably microprocessor(s)) and associated memory and storage (read only, programmable read only, random access, hard drive, etc.) executing one or more software or firmware programs or routines, combinational logic circuit(s), input/output circuit(s) and devices, appropriate signal conditioning and buffer circuitry, and other components to provide the described functionality. Software, firmware, programs, instructions, routines, code, algorithms and similar terms mean any controller executable instruction sets including calibrations and look-up tables. The control module has a set of control routines executed to provide the desired functions. Routines are executed, such as by a central processing unit, and are operable to monitor inputs from sensing devices and other networked control modules, and execute control and diagnostic routines to control operation of actuators. Routines may be executed at regular intervals, for example each 3.125, 6.25, 12.5, 25 and 100 milliseconds during ongoing engine and vehicle operation.

The method embodied in the control scheme 500 is executed to monitor engine cranking to detect and distinguish a fault associated with the battery 20 from a fault associated with the starter motor 16 while monitoring available parameters including engine rotational speed, cranking voltage and elapsed cranking time. As described herein, the control scheme 500 evaluates the starting system 12 described with reference to FIG. 1 by monitoring engine speed, elapsed time, and battery voltage during engine cranking without a need for additional sensing systems.

Table 2 is provided as a key wherein the numerically labeled blocks and the corresponding functions are set forth as follows.

TABLE 2

FIG. 5

| BLOCK | BLOCK CONTENTS |
|---|---|
| 502 | Execute Engine Start |
| 504 | Execute Cranking Event |
| 506 | Monitor Tcool, N, SOC, Tbat, Vbat, Vmin, $t_{200}$, $t_{crank}$ |
| 508 | Calculate $A_{200} = 200/t_{200}$ |
| 510 | Is Vmin > Vmin_th($A_{200}$)? |
| 512 | Is $A_{200} > A_{200}$_th? |
| 514 | Is SOC_startup < SOC_startup(Tbat)? |
| 516 | Detect starter motor fault |
| 518 | Detect Low SOC |
| 520 | Detect Battery fault |
| 530 | System Functional |

The control scheme 500 is executed during each engine starting event. Upon a command to execute an engine start event (502), a cranking event is executed (504). The engine speed is at 0 RPM prior to the cranking event.

Engine and system parameters are monitored during the cranking event, and include engine coolant temperature (Tcool), engine speed (N) in RPM, temperature of the starter battery (Tbat), starting system voltage (Vbat) including a minimum starting system voltage (Vmin), battery SOC, and elapsed cranking time ($t_{crank}$), including an elapsed cranking time to achieve a minimum engine speed threshold. In one embodiment, the elapsed cranking time to achieve a minimum engine speed threshold is associated with a minimum engine speed threshold of 200 RPM ($t_{200}$) (506). The minimum engine speed threshold may be set to another engine speed magnitude.

A value for the average engine acceleration parameter $A_{200}$ is calculated using the minimum engine speed threshold (200 RPM) and the elapsed time for the engine speed to achieve the engine speed threshold $t_{200}$ during the cranking event using EQ. 2, above (508).

The minimum starting system voltage is compared to a threshold minimum starting system voltage that is preferably determined in relation to the average engine acceleration parameter (Is Vmin>Vmin_th($A_{200}$)?) (510). The threshold minimum starting system voltage determined in relation to the average engine acceleration parameter (Vmin_th($A_{200}$)) may be determined using a relationship that is analogous to that shown with reference to FIG. 4, and may include other factors, e.g., ambient temperature, battery temperature, engine temperature, and other parameters.

When the minimum starting system voltage is greater than the threshold minimum starting system voltage determined in relation to the average engine acceleration parameter (510)(1), a fault associated with the starter motor is indicated (516). This evaluation is based upon a relation between operational health of the starter motor and internal resistance of the starter motor, with degradation in the performance of the starter motor correlated to an increase in the internal resistance, which is shown using EQ. 1 and the isometric lines 430, 432, 434, 436, 438, and 440 for the starter motor resistances $R_m$ shown with reference to FIG. 4.

When the minimum starting system voltage is less than the threshold minimum starting system voltage determined in relation to the average engine acceleration parameter (510)(0), operation of the control scheme 500 continues. The average engine acceleration parameter is compared to a threshold average engine acceleration parameter (Is $A_{200}>A_{200}$_th?) (512). When the average engine acceleration parameter is greater than the minimum threshold for the average engine acceleration parameter (512)(1), it is an indication that the cranking system 12 including the battery 20 is operating as intended (530).

When the average engine acceleration parameter is less than the minimum threshold for the average engine acceleration parameter (512)(0), operation of the control scheme 500 continues. At this point, there is a determination that there is a fault in the battery, which has either a low SOC or a high internal resistance $R_b$.

A battery SOC at engine startup is compared to a threshold battery SOC at engine startup that is determined in relation to the temperature of the starter battery (Is SOC_startup>SOC_startup(Tbat)?) (514). When the battery SOC at engine startup is greater than the threshold battery SOC at engine startup (514)(1), it is an indication that the battery SOC is low, and there is a need to charge the battery (518). When the battery SOC at engine startup is less than the threshold battery SOC at engine startup (514)(0), it indicates that the battery SOH is low and there is a need to replace the battery (520).

The logic associated with the decision that the battery SOH is low with an accompanying need to replace the battery is indicated by the previous steps. The previous steps have indicated that the minimum starting system voltage Vmin is less than the threshold minimum starting system voltage determined in relation to the average engine acceleration parameter (510)(0) and the average engine acceleration parameter $A_{200}$ is less than the minimum threshold for the average engine acceleration parameter (512)(0). Thus, the battery is not operating as intended, and it needs charged, or its internal resistance has increased thus affected it capability to work in the starting system 12 to start the engine 10. An increase in the internal resistance is indicated by the average engine acceleration parameter $A_{200}$ being less than the minimum threshold for the average engine acceleration parameter and the battery SOC at engine startup being greater than the threshold battery SOC at engine startup.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A control module-implemented method for evaluating a starting system for an internal combustion engine, the starting system including a starter motor and a battery, comprising:

monitoring engine speed, cranking time, and battery voltage during an engine cranking event, said engine cranking event comprising the engine speed increasing from an engine speed of zero to an engine speed threshold;

detecting and distinguishing, via a control module, between first and second faults resulting in a non-start event of the engine, wherein detecting the first and second faults comprises:

detecting the first fault associated with the starter motor when a minimum starting system voltage during the cranking event is greater than a threshold minimum starting system voltage determined in relation to an engine acceleration parameter, wherein the engine acceleration parameter is calculated by dividing the engine speed threshold by the cranking time for the engine speed to achieve the engine speed threshold; and only if the first fault associated with the starter motor is not detected, detecting the second fault associated with the battery when the engine acceleration parameter is less than a minimum threshold for the engine acceleration parameter during the cranking event.

2. The method of claim 1, wherein said cranking event comprises an engine speed increasing from an engine speed of 0 RPM to a preset engine speed threshold.

3. The method of claim 2, wherein the preset engine speed threshold comprises 200 RPM and the engine acceleration parameter comprises an average engine acceleration during the cranking event.

4. The method of claim 1, further comprising determining the starter motor and the battery are functioning as intended when the engine acceleration parameter is greater than the minimum threshold for the engine acceleration parameter.

5. The method of claim 1, wherein detecting the fault associated with the battery when the engine acceleration parameter is less than the minimum threshold for the engine acceleration parameter comprises detecting a battery fault when a battery state-of-charge during the cranking event is greater than a threshold battery state-of-charge.

6. The method of claim 5, wherein detecting the battery fault comprises detecting a low state-of-charge of the battery.

7. The method of claim 1, wherein detecting the fault associated with the battery when the engine acceleration parameter is less than the minimum threshold for the engine acceleration parameter comprises detecting a battery fault when a battery state-of-charge during the cranking event is less than a threshold battery state-of-charge.

8. The method of claim 7, wherein detecting the battery fault when the battery state-of-charge during the cranking event is less than the threshold battery state-of-charge comprises detecting a low state-of-health of the battery.

9. A control module-implemented method for evaluating a starting system for an internal combustion engine, the starting system including a starter motor and a battery, comprising:

cranking the engine, said cranking comprising increasing the engine speed from an engine speed of zero to an engine speed threshold;

monitoring engine speed, cranking time, and battery voltage during engine cranking;

determining an engine acceleration parameter by dividing the engine speed threshold by the cranking time for the engine speed to achieve the engine speed threshold;

determining a minimum battery voltage during engine cranking; and detecting and distinguishing, via a control module, between first and second faults resulting in a non-start event of the engine, wherein detecting the first and second faults comprises:

detecting the first fault associated with the starter motor only when the minimum battery voltage during engine cranking is greater than a threshold cranking voltage corresponding to the engine acceleration parameter; and only if the first fault associated with the starter motor is not detected, detecting the second fault associated with the battery when the engine acceleration parameter is less than a minimum threshold for the engine acceleration parameter.

10. The method of claim 9, further comprising determining a state-of-charge of the battery, wherein detecting the fault associated with the battery when the engine acceleration parameter is less than the minimum threshold for the engine acceleration parameter comprises:

detecting a first fault associated with the battery when the state-of-charge of the battery is greater than a state-of-charge threshold; and detecting a second fault associated with the battery when the state-of-charge of the battery is less than the state-of-charge threshold.

11. The method of claim 10, wherein the state-of-charge threshold is determined in relation to a temperature of the battery.

12. A control module-implemented method for evaluating a starting system for an internal combustion engine, the starting system including a starter motor and a battery, comprising:

cranking the engine, said cranking comprising increasing the engine speed from an engine speed of zero to an engine speed threshold;

monitoring engine speed, cranking time, and battery voltage during engine cranking;

determining an engine acceleration parameter by dividing the engine speed threshold by the cranking time for the engine speed to achieve the engine speed threshold;

determining a minimum battery voltage during engine cranking; and detecting and distinguishing, via a control module, between first and second faults resulting in a non-start event of the engine, wherein detecting the first and second faults comprises:

detecting the first fault associated with the starter motor when a minimum starting system voltage during the cranking event is greater than a threshold minimum starting system voltage determined in relation to the engine acceleration parameter; and only if the first fault associated with the starter motor is not detected, detecting a fault associated with the battery only when the minimum battery voltage during engine cranking is less than a threshold cranking voltage corresponding to the engine acceleration parameter and the engine acceleration parameter is less than a minimum threshold for the engine acceleration parameter during the cranking event.

13. The method of claim 12, wherein detecting the fault associated with the battery comprises detecting a battery fault when a battery state-of-charge during engine cranking is greater than a threshold battery state-of-charge.

14. The method of claim 13, wherein detecting the battery fault comprises detecting a low state-of-charge of the battery.

15. The method of claim 12, wherein detecting the fault associated with the battery comprises detecting a battery fault when a battery state-of-charge during engine cranking is less than a threshold battery state-of-charge.

16. The method of claim 15, wherein detecting the second battery fault comprises detecting a low state-of-health of the battery.

17. The method of claim 12, further comprising determining the starter motor and the battery are functioning as intended when the engine acceleration parameter is greater than the minimum threshold for the engine acceleration parameter.

* * * * *